US010626745B2

(12) United States Patent
Roussille et al.

(10) Patent No.: US 10,626,745 B2
(45) Date of Patent: Apr. 21, 2020

(54) TURBINE RING ASSEMBLY SUPPORTED BY FLANGES

(71) Applicant: SAFRAN AIRCRAFT ENGINES, Paris (FR)

(72) Inventors: Clement Roussille, Bordeaux (FR); Gael Evain, Fontenay-Tresigny (FR); Aline Planckeel, Le Haillan (FR); Claire Groleau, Montrouge (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 239 days.

(21) Appl. No.: 15/575,968

(22) PCT Filed: May 19, 2016

(86) PCT No.: PCT/FR2016/051175

§ 371 (c)(1),
(2) Date: Nov. 21, 2017

(87) PCT Pub. No.: WO2016/189224

PCT Pub. Date: Dec. 1, 2016

(65) Prior Publication Data

US 2018/0149034 A1 May 31, 2018

(30) Foreign Application Priority Data

May 22, 2015 (FR) ..... 15 54627

(51) Int. Cl.
*F01D 11/12* (2006.01)
*F01D 25/24* (2006.01)
*F01D 11/08* (2006.01)

(52) U.S. Cl.
CPC ..... *F01D 11/127* (2013.01); *F01D 11/08* (2013.01); *F01D 25/246* (2013.01); (Continued)

(58) Field of Classification Search
CPC ..... F01D 11/127; F01D 25/246; F01D 11/08; F01D 11/12; F01D 25/24; F01D 11/122; (Continued)

(56) References Cited

U.S. PATENT DOCUMENTS 4,650,394 A * 3/1987 Weidner ..... F01D 11/08 415/115
5,603,510 A * 2/1997 Sanders ..... F01D 11/025 277/413

(Continued)

FOREIGN PATENT DOCUMENTS

FR 2 955 898 A1 8/2011
FR 3 009 740 A1 2/2015
WO WO 2014/140493 A1 9/2014

OTHER PUBLICATIONS

International Search Report dated Oct. 18, 2016 in PCT/FR2016/051175 filed May 19, 2016.

*Primary Examiner* — Aaron R Eastman
(74) *Attorney, Agent, or Firm* — Oblon, McClelland, Maier & Neustadt, L.L.P.

(57) ABSTRACT

A turbine ring assembly includes both a plurality of ring sectors made of ceramic matrix composite material forming a turbine ring and also a ring support structure having first and second annular flanges, each ring sector having first and second tabs, the tabs of each ring sector being held between the two annular flanges of the ring support structure. Each of the first and second tabs of the ring sectors has an annular groove. Each of the first and second annular flanges of the ring support structure has an annular projection received respectively in the annular groove of the first tab or in the annular groove of the second tab of each ring sector. A resilient element is interposed between the annular projection of the first flange and the annular grooves of the first tabs, and also between the annular projection of the second flange and the annular grooves of the second tabs.

10 Claims, 8 Drawing Sheets

(52) U.S. Cl.
CPC .... *F05D 2230/642* (2013.01); *F05D 2240/11* (2013.01); *F05D 2300/6033* (2013.01)

(58) Field of Classification Search
CPC ..... F01D 11/10; F05D 2230/642; F05D 2240/11; F05D 2300/6033; F05D 2240/55
USPC ..... 415/173.1
See application file for complete search history.

(56) References Cited

U.S. PATENT DOCUMENTS

| | | | | |
|---|---|---|---|---|
| 6,302,642 | B1 | 10/2001 | Nagler et al. | |
| 6,315,519 | B1 | 11/2001 | Bagepalli et al. | |
| 6,368,054 | B1 * | 4/2002 | Lucas | F01D 11/08 415/135 |
| 6,406,256 | B1 | 6/2002 | Marx | |
| 6,572,115 | B1 * | 6/2003 | Sarshar | F16J 15/3288 277/412 |
| 6,932,566 | B2 * | 8/2005 | Suzumura | F01D 11/08 415/135 |
| 7,207,771 | B2 * | 4/2007 | Synnott | F01D 11/08 415/173.1 |
| 7,229,246 | B2 * | 6/2007 | Ghasripoor | F04D 29/126 415/173.3 |
| 7,435,049 | B2 * | 10/2008 | Ghasripoor | F01D 5/225 277/415 |
| 9,945,243 | B2 * | 4/2018 | O'Leary | F01D 11/12 |
| 2002/0192074 | A1 * | 12/2002 | Turnquist | F01D 11/122 415/173.3 |
| 2009/0053050 | A1 * | 2/2009 | Bruce | F01D 25/04 415/200 |
| 2016/0245122 | A1 | 8/2016 | Rosset et al. | |

* cited by examiner

TURBINE RING ASSEMBLY SUPPORTED BY FLANGES

BACKGROUND OF THE INVENTION

The field of application of the invention lies in particular with gas turbine aeroengines. Nevertheless, the invention is applicable to other turbine engines, e.g. industrial turbines.

Ceramic matrix composite (CMC) materials are known for conserving their mechanical properties at high temperatures, which makes them suitable for constituting hot structural elements.

In gas turbine aeroengines, improving efficiency and reducing certain polluting emissions lead to seeking operation at ever higher temperatures. With turbine ring assemblies that are made entirely out of metal, it is necessary to cool all of the elements of the assembly and in particular the turbine ring that is subjected to very hot streams, typically at temperatures higher than the temperature that can be withstood by the metal material. Such cooling has a significant impact on the performance of the engine, since the cooling stream used is taken from the main stream through the engine. In addition, the use of metal for the turbine ring limits potential for increasing temperature in the turbine, even though that would make it possible to improve the performance of aeroengines.

That is why it has already been envisaged to make use of CMC for various hot portions of engines, particularly since CMCs present the additional advantage of density that is lower than that of the refractory metals conventionally used.

Thus, making single-piece turbine ring sectors out of CMC is described in particular in Document US 2012/0027572. The ring sectors comprise an annular base having an inner face defining the inside face of the turbine ring and an outer face from which there extend two tab-forming portions having their ends engaged in housings of a metal structure of the ring support.

The use of CMC ring sectors makes it possible to reduce significantly the amount of ventilation needed for cooling the turbine ring. Nevertheless, holding ring sectors in position remains a problem, in particular in the face of differential expansion that can occur between the metal support structure and the CMC ring sectors. In addition, another problem lies in the stresses generated by the imposed movements. Furthermore, ring sectors need to be held in position even in the event of contact between the tip of a blade of a rotor wheel and the inside faces of the ring sectors.

OBJECT AND SUMMARY OF THE INVENTION

The invention seeks to avoid such drawbacks, and for this purpose it proposes a turbine ring assembly comprising both a plurality of ring sectors made of ceramic matrix composite material forming a turbine ring and also a ring support structure having first and second annular flanges, each ring sector having a portion forming an annular base with an inner face defining the inside face of the turbine ring and an outer face from which first and second tabs extend radially, the tabs of each ring sector being held between the two annular flanges of the ring support structure, the first and second tabs of the ring sectors each having an annular groove in its face respectively facing the first annular flange and the second annular flange of the ring support structure, the first and second annular flanges of the ring support structure each having an annular projection on its face facing one of the ring sector tabs, the annular projection of the first flange being received in the annular groove of the first tab of each ring sector, while the annular projection of the second flange is received in the annular groove of the second tab of each ring sector, at least one resilient element being interposed between the annular projection of the first flange and the annular grooves of the first tabs, and also between the annular projection of the second flange and the annular grooves of the second tabs. Each resilient element is interposed between the top walls of the grooves present in the first tabs, or respectively the second tabs, of the ring sectors and the top wall of the annular projection of the first flange, or respectively of the second flange, of the ring structure; or else each resilient element is interposed between the bottom walls of the grooves present in the first tabs, or respectively the second tabs of the ring sectors and the bottom wall of the annular projection of the first flange, or respectively of the second flange, of the ring structure.

By using the above-defined attachment geometry for the ring sectors and by interposing a resilient element between the projections of the flanges and the grooves in the tabs of the ring sectors, it is ensured that the ring sectors are held in position even in the event of differential expansion between the sectors and the support structure, such expansion being compensated by the holding being resilient.

In an embodiment of the turbine ring assembly of the invention, each resilient element is formed by a split annular collar mounted with elastic prestress between one of the annular projections and the corresponding grooves.

In another embodiment of the turbine ring assembly of the invention, each resilient element is formed by at least one strip of a rigid material presenting a corrugated shape. Under such circumstances, the resilient element may be made of corrugated sheet.

According to a particular characteristic of the turbine ring assembly of the invention, the projections of the two annular flanges of the ring support structure exert stress on the annular grooves of the tabs of the ring sectors, one of the flanges of the ring support structure being elastically deformable in the axial direction of the turbine ring.

By holding the ring sectors between flanges that exert stress on the tabs of the sectors via their projections, with this being done with flanges of the ring support structure that are elastically deformable, contact is further improved and consequently sealing between the flanges and the tabs is improved, even when these elements are subjected to high temperatures. Specifically, the ability of one of the flanges of the ring structure to deform elastically makes it possible to compensate for differential expansion between the tabs of the CMC ring sectors and the flanges of the metal ring support structure without significantly increasing the stress that is exerted when "cold" by the flanges on the tabs of the ring sectors.

In particular, the elastically deformable flange of the ring support structure may present thickness that is smaller than the thickness of the other flange of the ring support structure.

In another aspect of the turbine ring assembly of the invention, it further comprises a plurality of pegs engaged both in at least one of the annular flanges of the ring support structure and in the tabs of the ring sectors facing said at least one annular flange. The pegs serve to prevent any potential turning of the ring sectors within the ring support structure.

In another aspect of the turbine ring assembly of the invention, the elastically deformable flange of the ring support structure has a plurality of hooks distributed over its face opposite from its face facing the tabs of the ring sectors. The presence of hooks makes it possible to facilitate moving the elastically deformable flange away in order to insert the tabs of the ring sectors between the flanges without needing to force the tabs to slide between the flanges.

In another embodiment of the turbine ring assembly of the invention, the ring support structure includes an annular retention band mounted on the turbine casing, the annular retention band including an annular web forming one of the flanges of the ring support structure. The band has a first series of teeth distributed in circumferential manner on said band while the turbine casing has a second series of teeth distributed in circumferential manner on said casing, the teeth of the first series of teeth and the teeth of the second series of teeth together forming a circumferential twist-lock jaw coupling. This connection by twist-lock jaw coupling enables the ring sectors to be mounted and removed easily.

In another aspect of the turbine ring assembly of the invention, the turbine casing includes an annular projection extending between a shroud of the casing and the band of the ring structure. This prevents upstream to downstream leaks between the casing and the band.

BRIEF DESCRIPTION OF THE DRAWINGS

The invention can be better understood on reading the following description given by way of non-limiting indication and with reference to the accompanying drawings, in which.

DETAILED DESCRIPTION OF EMBODIMENTS

Figure 1:
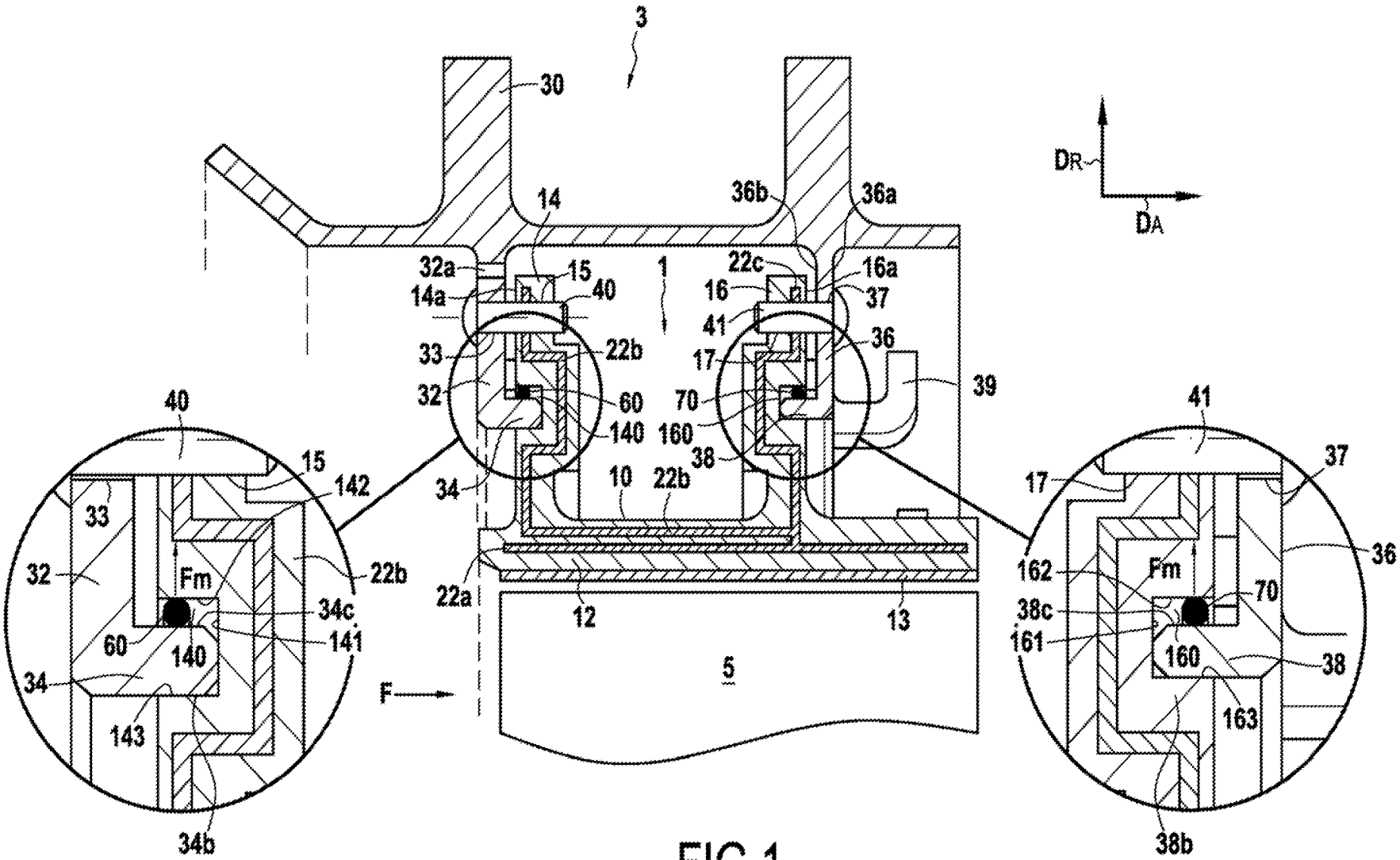
FIG. 1 is a radial half-section view showing an embodiment of a turbine ring assembly of the invention.

FIG. 1 shows a ring assembly for a high-pressure turbine, the assembly comprising a turbine ring 1 made of ceramic matrix composite (CMC) material together with a metal ring support structure 3. The turbine ring 1 surrounds a set of rotary blades 5. The turbine ring 1 is made of a plurality of ring sectors 10, with FIG. 1 being a radial section view on a plane passing between two contiguous ring sectors. Arrow $D_A$ indicates the axial direction relative to the turbine ring 1, while arrow $D_R$ indicates the radial direction relative to the turbine ring 1.

Each ring sector 10 has a section that is substantially in the shape of an upside-down letter π, with an annular base 12 having its inner face coated in a layer 13 of abradable material defining the flow passage for the gas stream through the turbine. Upstream and downstream tabs 14 and 16 extend from the outer face of the annular base 12 in the radial direction $D_R$. The terms "upstream" and "downstream" are used herein relative to the flow direction of the gas stream through the turbine (arrow F).

The ring support structure 3 is secured to a turbine casing 30 that has an upstream annular radial flange 32 with a projection 34 on its face facing the upstream tabs 14 of the ring sectors 10, the projection 34 being received in an annular groove 140 present in the outer faces 14*a* of the upstream tabs 14. On the downstream side, the ring support structure has a downstream annular radial flange 36 with a projection 38 on its face facing the downstream tabs 16 of the ring sectors 10, the projection 38 being received in an annular groove 160 present in the outer face 16*a* of the downstream tabs 16.

As explained in detail below, the tabs 14 and 16 of each ring sector 10 are mounted with prestress between the annular flanges 32 and 36 in such a manner that, at least when "cold", i.e. at an ambient temperature of about 25° C., the flanges exert stress on the tabs 14 and 16.

Furthermore, in the presently-described example, the ring sectors 10 are also held by blocking pegs. More precisely, and as shown in FIG. 1, pegs 40 are engaged both in the annular upstream radial flange 32 of the ring support structure 3 and in the upstream tabs 14 of the ring sectors 10. For this purpose, each peg 40 passes through a respective orifice 33 formed in the annular upstream radial flange 32 and a respective orifice 15 formed in an upstream tab 14, the orifices 33 and 15 being put into alignment when mounting the ring sectors 10 on the ring support structure 3. Likewise, pegs 41 are engaged both in the annular downstream radial flange 36 of the ring support structure 3 and in the downstream tabs 16 of the ring sectors 10. For this purpose, each peg 41 passes through a respective orifice 37 formed in the annular downstream radial flange 36 and a respective orifice 17 formed in a downstream tab 16, the orifices 37 and 17 being put into alignment when mounting the ring sectors 10 on the ring support structure 3.

Furthermore, sealing between sectors is provided by sealing tongues received in grooves that face each other in the facing edges of two neighboring ring sectors. A tongue 22*a* extends over nearly all of the length of the annular base 12 in the middle portion thereof. Another tongue 22*b* extends along the tab 14 and over a portion of the annular base 12. Another tongue 22*c* extends along the tab 16. At one end, the tongue 22*c* comes into abutment against the tongue 22*a* and against the tongue 22*b*. The tongues 22*a*, 22*b*, and 22*c* are made of metal for example and they are mounted without clearance when cold in their housings so as to ensure that the sealing function is provided at the temperatures encountered in service.

In conventional manner, ventilation orifices 32*a* formed in the flange 32 enable cooling air to be delivered to cool the outside of the turbine ring 10.

In accordance with the present invention, at least one resilient element is interposed between each projection of the annular flanges of the ring support structure and each annular groove in the tabs of the ring sectors. More precisely, in the presently-described embodiment, a split annular collar 60 is interposed between the top walls 142 of the grooves 140 present in the outer faces 14*a* of the upstream tabs 14 of the ring sectors 10 and the top face 34*c* of the projection 34 of the upstream annular radial flange 32, and a split annular collar 70 is interposed between the top walls 162 of the grooves 160 present in the outer faces 16*a* of the downstream tabs 16 of the ring sectors 10 and the top face 38*c* of the projection 38 of the downstream annular radial flange 36. The split annular collars 60 and 70 constitute elements that are resilient in that when they are in the free state, i.e. prior to being mounted, they present a radius that is greater than the radius defined by the top walls 142 and 162 of the annular grooves 140 and 160, respectively. The split annular collars 60 and 70 may be made out of René 41 alloy, for example. Prior to mounting, an elastic stress is applied to the collars 60 and 70 in order to tighten them and reduce their radius so as to be able to insert them in the grooves 140 and 160. Once placed in the grooves 140 and 160, the collars 60 and 70 expand and press against the top walls 142 and 162 of the annular grooves 140 and 160. The collars 60 and 70 thus serve to hold the ring sectors 10 in position on the ring support structure 3. More precisely, the collars 60 and 70 exert a holding force Fm on the ring sectors 10 that is directed in the radial direction DR and that serves to ensure contact firstly between the bottom walls 143 of the grooves 140 of the upstream tabs 14 with the bottom face 34*b* of the projection 34 of the upstream annular radial flange 32, and secondly between the bottom walls 163 of the grooves 160 of the upstream tabs 16 with the bottom face 38*b* of the projection 38 of the downstream annular radial flange 36 (FIG. 1).

There follows a description of a method of making a turbine ring assembly corresponding to the assembly shown in FIG. 1.

Each above-described ring sector 10 is made of ceramic matrix composite (CMC) material by forming a fiber preform of shape close to the shape of the ring sector and by densifying the ring sector with a ceramic matrix.

In order to make the fiber preform, it is possible to use yarns made of ceramic fibers, e.g. SiC fiber yarns such as those sold by the Japanese supplier Nippon Carbon under the name "Nicalon", or yarns made of carbon fibers.

The fiber preform is advantageously made by three-dimensional weaving or by multilayer weaving, with zones of non-interlinking being arranged to allow the portions of the preforms that correspond to the tabs 14 and 16 to be moved away from the sectors 10.

The weaving may be of the interlock type as shown. Other three-dimensional or multilayer weaves may be used, such as for example multi-plain or multi-satin weaves. Reference may be made to Document WO 2006/136755.

After weaving, the blank may be shaped in order to obtain a ring sector preform that is consolidated and densified with a ceramic matrix, it being possible for densification to be performed in particular by chemical vapor infiltration (CVI), which is well known in itself.

A detailed example of fabricating CMC ring sectors is described in particular in Document US 2012/0027572.

The ring support structure 3 is made of a metal material such as a Waspaloy® alloy or Inconel 718.

Figure 2:
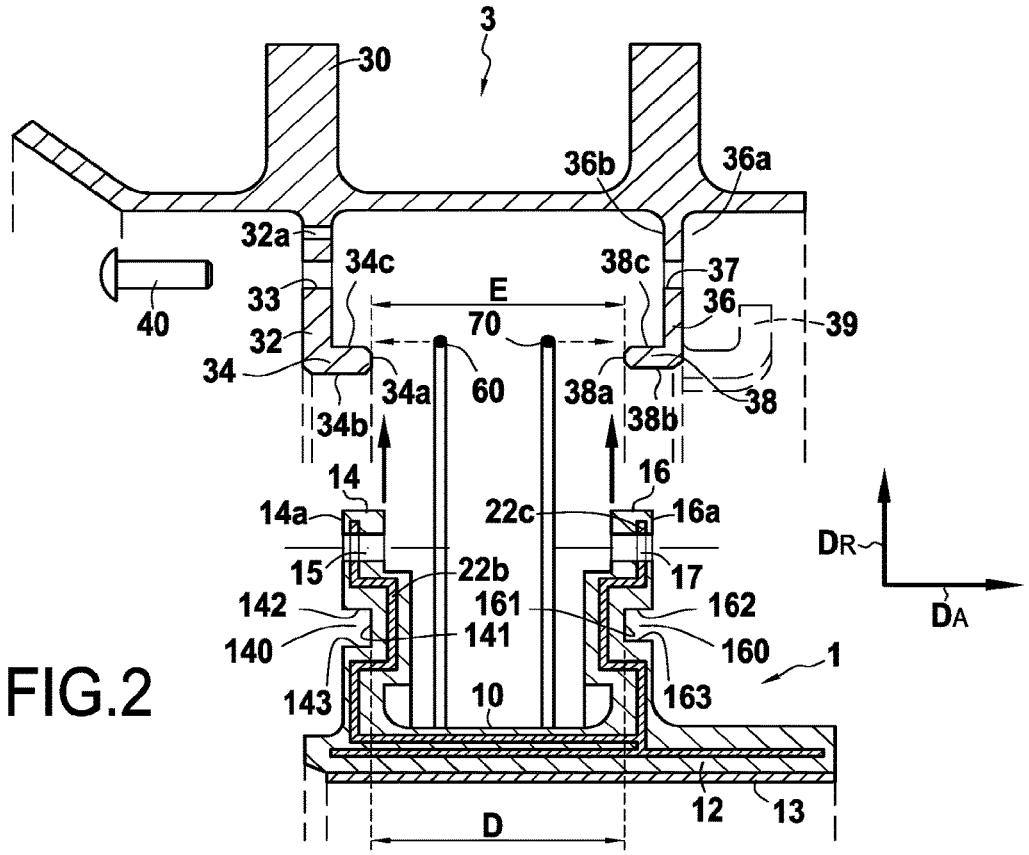
FIGS. 2 to 4 are diagrams showing how a ring sector is mounted in the ring support structure of the FIG. 1 ring assembly.

Making of the turbine ring assembly continues by mounting the ring sectors 10 on the ring support structure 3. As shown in FIG. 2, the spacing E between the end 34*a* of the annular projection 34 of the upstream annular radial flange 32 and the end 38*a* of the annular projection 38 of the downstream annular radial flange 36 while "at rest", i.e. when no ring sector is mounted between the flanges, is smaller than the distance D present between the end walls 141 and 161 of the annular grooves 140 and 160 respectively in the upstream and downstream tabs 14 and 16 of the ring sectors.

By defining a spacing E between the projections of the flanges of the ring support structure that is smaller than the distance D between the end walls of the grooves of the tabs of each ring sector, it is possible to mount the ring sectors with prestress between the flanges of the ring support structure. Nevertheless, in order to avoid damaging the tabs of the CMC ring sectors during mounting, and in accordance with the invention, the ring support structure includes at least one annular flange that is elastically deformable in the axial direction $D_A$ of the ring. In the presently-described example, it is the annular downstream radial flange 36 that is elastically deformable. Specifically, the annular downstream radial flange 36 of the ring support structure 3 presents thickness that is small compared with the annular upstream radial flange 32, and it is that which imparts a degree of resilience thereto.

Prior to mounting the ring sectors 10 on the ring support structure 3, the split collars 60 and 70 are placed respectively against the top walls 34*c* and 38*c* of the projections 34 and 38 of the annular radial flanges 32 and 36.

Figure 3:
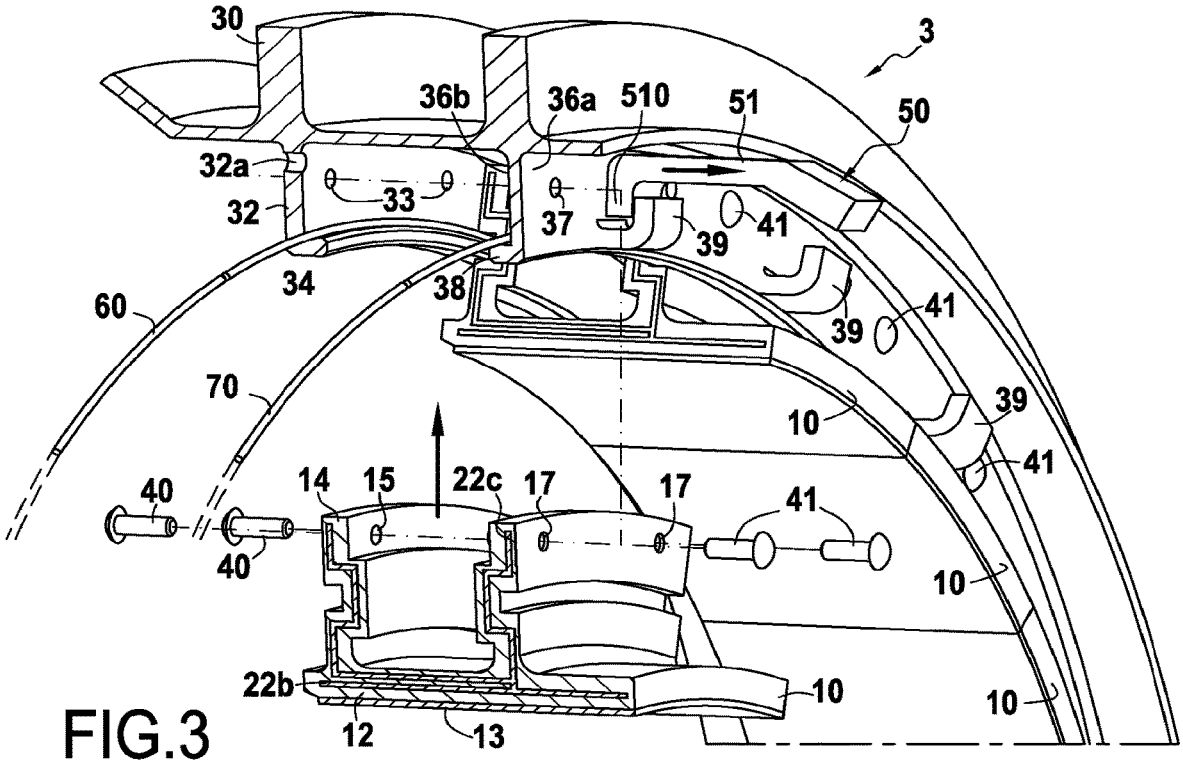
Figure 4:
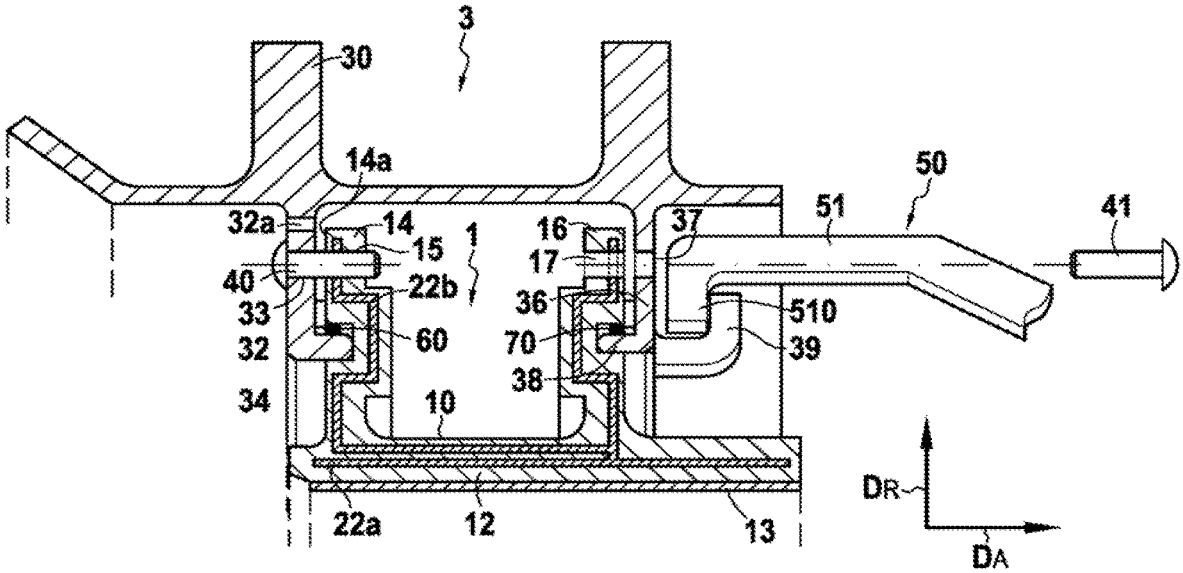

Thereafter, the ring sectors 10 are mounted one after another on the ring support structure 3. While mounting a ring sector 10, the downstream annular radial flange 36 is pulled in the direction $D_A$ as shown in FIGS. 3 and 4 in order to increase the spacing between the flanges 32 and 36 so as to enable the projections 34 and 38 present respectively on the flanges 32 and 36 to be inserted in the grooves 140 and 160 present in the tabs 14 and 16 without risk of damaging the ring sector 10. Once the projections 34 and 38 of the flanges 14 and 16 are inserted in the grooves 140 and 160 of the tabs 14 and 16, and once said tabs 14 and 16 are positioned so as to align the orifices 33 and 15 and also 17 and 37, the flange 36 is released. The respective projections 34 and 38 of the flanges 32 and 36 then exert axial holding stress (direction $D_A$) on the tabs 14 and 16 of the ring sector, while the collars 60 and 70 exert radial stress (direction $D_R$) on the tabs 14 and 16 of the sectors. In order to make it easier to move the downstream annular radial flange 36 away by traction, it has a plurality of hooks 39 distributed over its face 36*a*, which face is opposite from the face 36*b* of the flange 36 that faces the downstream tabs 16 of the ring sectors 10 (FIG. 3). In this example, the traction in the axial direction $D_A$ of the ring that is exerted on the elastically deformable flange 36 is applied by means of a tool 50 having at least one arm 51 with its end including a hook 510 that is engaged in a hook 39 present on the outer face 36*a* of the flange 36.

The number of hooks 39 distributed over the face 36*a* of the flange 36 is defined as a function of the number of traction points it is desired to have on the flange 36. This number depends mainly on the elastic nature of the flange. It is naturally possible in the ambit of the present invention to envisage other shapes and arrangements of means enabling traction to be exerted in the axial direction $D_A$ on one of the flanges of the ring support structure.

Once the ring sector 10 is inserted and positioned between the flanges 32 and 36, pegs 40 are engaged in the aligned orifices 33 and 15 formed respectively in the annular upstream radial flange 32 and in the upstream tab 14, and pegs 41 are engaged in the aligned orifice 37 and 17 formed respectively in the annular downstream radial flange 36 and in the downstream tab 16. Each tab 14 or 16 of a ring sector may have one or more orifices for passing a blocking peg.

Figure 5:
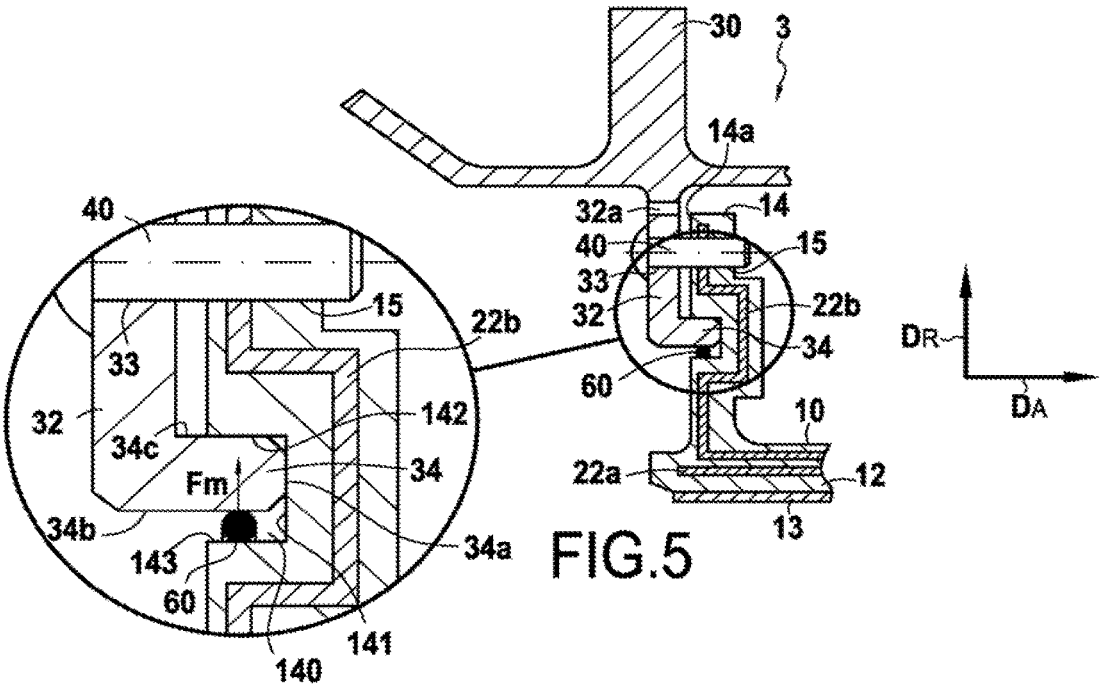
FIG. 5 is a fragmentary half-section view showing a variant embodiment of the FIG. 1 turbine ring assembly.

In a variant embodiment, the collars 60 and 70 may be placed between the bottom walls of the grooves in the tabs of the ring sectors and the bottom faces of the projections on the annular radial flanges. FIG. 5 shows this variant embodiment for the upstream tabs 14 of the ring sectors 10 and the upstream annular radial flange 32 of the ring support structure 3. In FIG. 5, the collar 60 is placed between the bottom wall 143 of the groove 140 in the upstream tab 14 of the ring sector 10 and the bottom face 34*b* of the projection 34 of the upstream annular radial flange 32. The collar 60 exerts a holding force Fm that is directed in the radial direction $D_R$ and that serves to ensure contact firstly between the top wall 142 of the groove 140 in the upstream tab 14 and the top face 34*c* of the projection 34 of the upstream annular radial flange 32.

Figure 6:
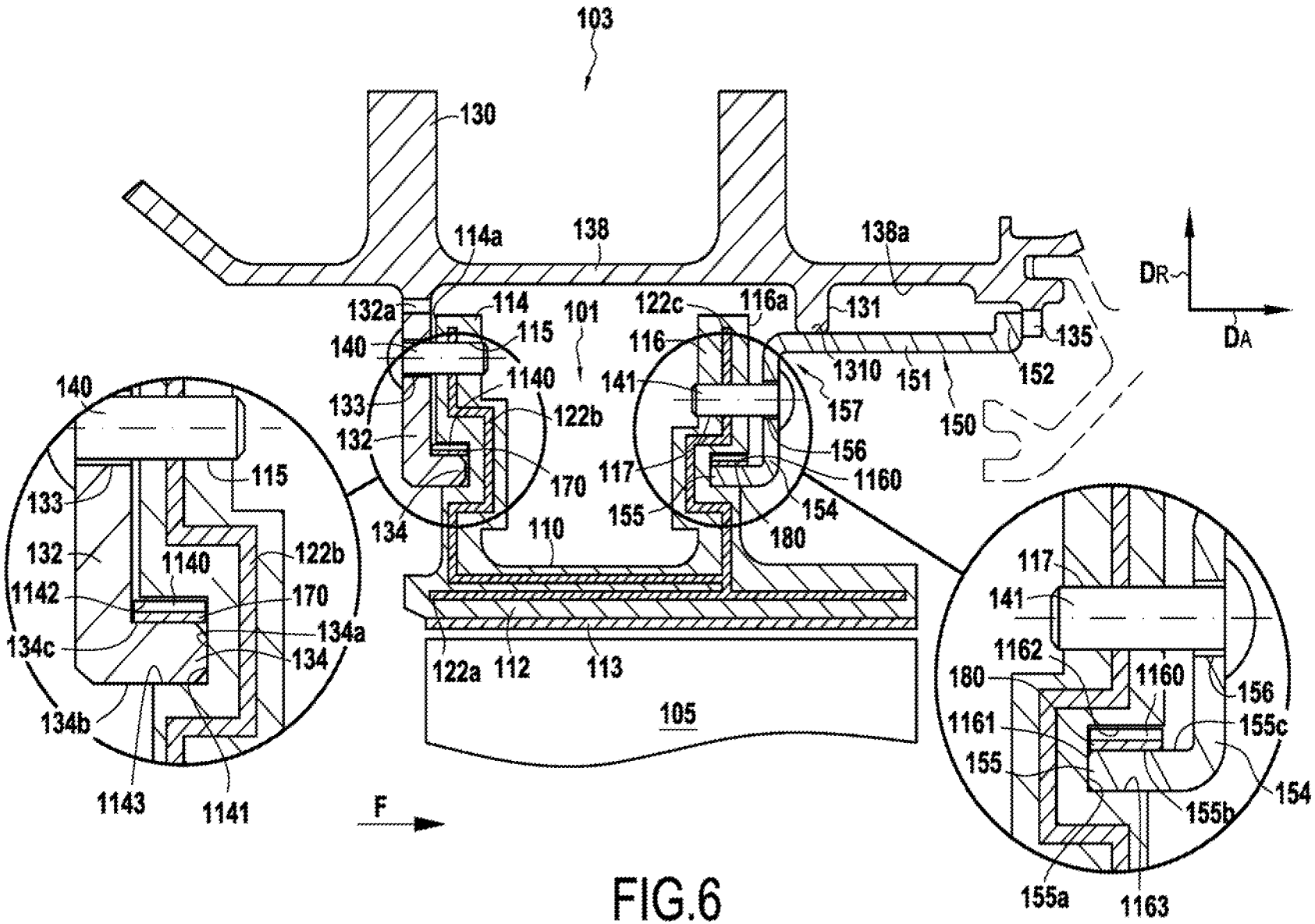
FIG. 6 is a radial half-section view showing an embodiment of a turbine ring assembly of the invention.

FIG. 6 shows a ring assembly for a high pressure turbine in accordance with another embodiment of the invention. As described above, the high pressure turbine ring assembly comprises a turbine ring 101 made of ceramic matrix composite (CMC) material and a metal ring support structure 103. The turbine ring 101 surrounds a set of rotary blades 105. The turbine ring 101 is made up of a plurality of ring sectors 110, FIG. 6 being a radial section view on a plane lying between two contiguous ring sectors. Arrow $D_A$ indicates the axial direction relative to the turbine ring 101, while arrow $D_R$ indicates the radial direction relative to the turbine ring 101.

Each ring sector 110 has a section that is substantially in the shape of an upside-down letter π with an annular base 112 having its inner face coated in a layer 113 of abradable material defining the flow passage for the gas stream through the turbine. The upstream and downstream tabs 114 and 116 extend from the outer face of the annular base 12 in the radial direction $D_R$. The terms "upstream" and "downstream" are used herein relative to the flow direction of the gas stream through the turbine (arrow F).

Figure 9:
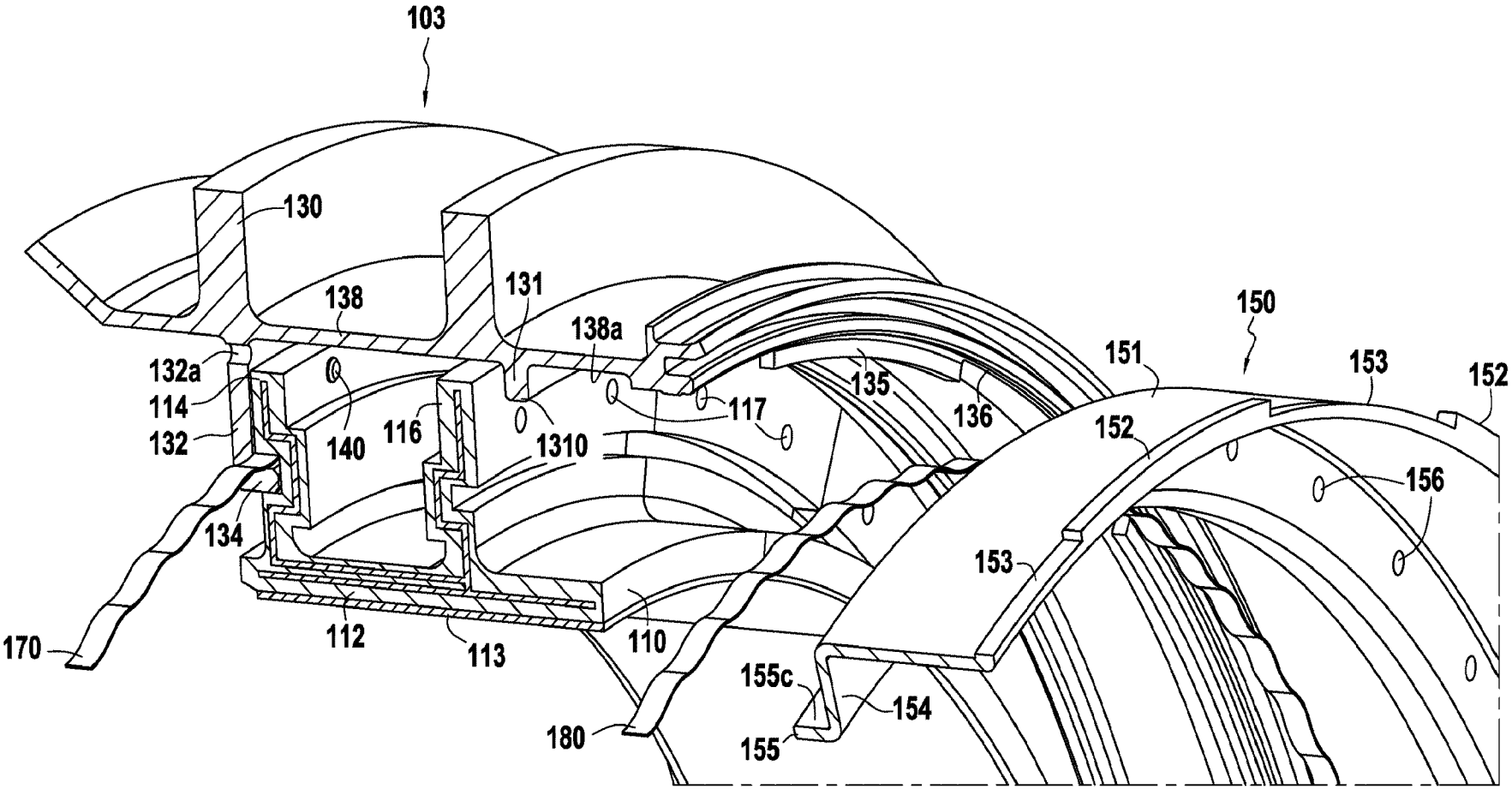
Figure 12:
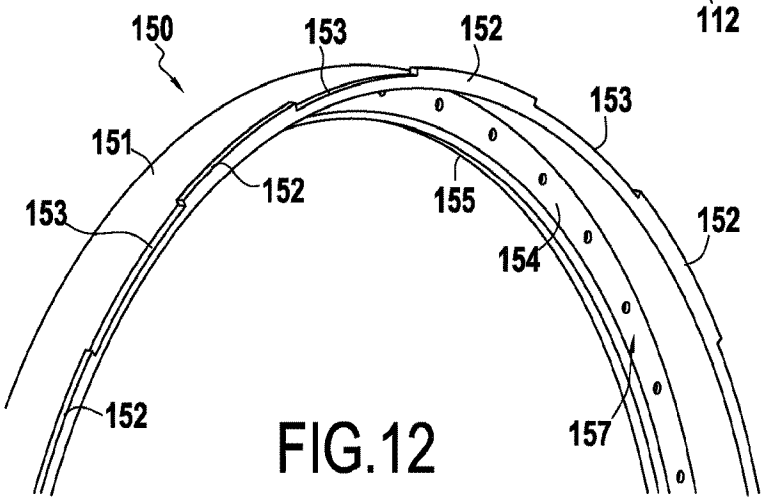
FIG. 12 is a diagrammatic perspective view of the retention band of FIGS. 6 and 8 to 11.

The ring support structure 103 is made up of two portions, namely a first portion corresponding to an upstream annular radial flange 132, which is preferably formed integrally with a turbine casing 130, and a second portion corresponding to an annular retention band 150 mounted on the turbine casing 130. The upstream annular radial flange 132 has a projection 134 on its face facing the upstream tabs 114 of the ring sectors 110, the projection 134 is received in annular grooves 1140 present in the outer faces 114*a* of the upstream tabs 114. On the downstream side, the band 150 comprises an annular web 157 that forms a downstream annular radial flange 154 having a projection 155 on its face facing the downstream tabs 116 of the ring sectors 110, the projection being received in annular grooves 160 present in the outer faces 116*a* of the downstream tabs 116. The band 150 comprises an annular body 151 extending axially and comprising, on its upstream side, the annular web 157, and on its downstream side, a first series of teeth 152 that are distributed circumferentially on the band 150 and that are spaced apart from one another by first engagement passages 153 (FIGS. 9 and 12). On its downstream side, the turbine casing 130 has a second series of teeth 135 extending radially from the inside surface of the shroud 138 of the turbine casing 130. The teeth 135 are distributed circumferentially on the inside surface 138*a* of the shroud 138 and they are spaced apart from one another by second engagement passages 136 (FIG. 9). The teeth 152 and 135 co-operate with one another to form a circumferential twist-lock jaw coupling.

As explained below in detail, the tabs 114 and 116 of each ring sector 110 are mounted with prestress between the annular flanges 132 and 154 so that, at least when "cold", i.e. at an ambient temperature of about 25° C., the flanges exert stress on the tabs 114 and 116.

Furthermore, in the presently-described example, the ring sectors 110 are also held by blocking pegs. More precisely, and as shown in FIG. 6, the pegs 140 are engaged both in the upstream annular radial flange 132 of the ring support structure 103 and in the upstream tabs 114 of the ring sectors 110. For this purpose, each peg 140 passes through a respective orifice 133 formed in the upstream annular radial flange 132 and a respective orifice 115 formed in an upstream tab 114, the orifices 133 and 115 being put into alignment while mounting the ring sectors 110 on the ring support structure 103. Likewise, the pegs 141 are engaged both in the downstream annular radial flange 154 of the band 150 and in the downstream tabs 116 of the ring sectors 110. For this purpose, each peg 141 passes through a respective orifice 156 formed in the downstream annular radial flange 154 and a respective orifice 117 formed in a downstream tab 116, the orifices 156 and 117 being put into alignment while mounting the ring sectors 110 on the ring support structure 103.

In addition, sealing between sectors is provided by sealing tongues housed in grooves that face one another in the facing edges of two neighboring ring sectors. A tongue 122*a* extends over nearly the entire length of the annular base 112 in the middle portion thereof. Another tongue 122*b* extends along the tab 114 and over a portion of the annular base 112. Another tongue 122*c* extends along the tab 116. At one end, the tongue 122*c* comes into abutment against the tongue 122*a* and the tongue 122*b*. By way of example, the tongues 122*a*, 122*b*, and 122*c* are made of metal and are mounted in their housings to have clearance when cold in order to perform the sealing function at the temperatures that are encountered in service.

In conventional manner, ventilation orifices 132*a* formed in the flange 132 serve to bring cooling air for cooling the outside of the turbine ring 110.

In addition, sealing between upstream and downstream of the turbine ring assembly is provided by an annular projection 131 extending radially from the inside face 138*a* of the shroud 138 of the turbine casing 103 and having its free end in contact with the surface of the body 151 of the band 150.

In accordance with the present invention, at least one resilient element is interposed between each projection of the annular flanges of the ring support structure and each annular groove in the tabs of the ring sectors. More precisely, in the presently-described embodiment, a split annular corrugated sheet 170 is interposed between the top walls 1142 of the grooves 1140 present in the outer faces 114*a* of the upstream tabs 114 of the ring sectors 110 and the top face 134*c* of the projection 134 of the upstream annular radial flange 132, while a split annular corrugated sheet 180 is interposed between the top walls 1162 of the grooves 1160 present in the outer faces 116*a* of the downstream tabs 116 of the ring sectors 110 and the top face 155*c* of the projection 155 of the downstream annular radial flange 154. The annular corrugated sheets 170 and 180 constitute the resilient elements. They may in particular be made of a metal material such as a René 41 alloy or out of a composite material such as a material of the A500 type constituted by carbon fiber reinforcement densified by an SiC/B self-healing matrix. The corrugated sheets 170 and 180 make contact in alternation with the annular grooves 1140 and 1160 and with the projections 134 and 155. The corrugated sheets 170 and 180 thus serve to hold the ring sectors 110 in position on the ring support structure 103. More precisely, the corrugated sheets 170 and 180 serve to hold the ring sectors 110 elastically in the radial direction $D_R$ via alternating points of contact, firstly between the top walls 1142 of the grooves 1140 of the upstream tabs 114 and the top face 134*c* of the projection 134 of the upstream annular radial flange 132 (for the sheet 170), and secondly between the top walls 1162 of the grooves 1160 of the upstream tabs 116 and the top face 155*c* of the projection 155 of the downstream annular radial flange 154 (for the sheet 180).

There follows a description of the method of making a turbine ring assembly corresponding to the assembly shown in FIG. 6.

Each above-described ring sector 110 is made of ceramic matrix composite (CMC) material by forming a fiber preform of shape close to the shape of the ring sector and by densifying the ring sector with a ceramic matrix.

In order to make the fiber preform, it is possible to use yarns made of ceramic fibers, e.g. yarns of SiC fibers such as those sold by the Japanese supplier Nippon Carbon under the name "Nicalon", or else yarns made of carbon fibers.

The fiber preform is advantageously made by three-dimensional weaving or multilayer weaving with zones of non-interlinking being provided so as to enable the portions of the preform that correspond to the tabs 114 and 116 to be moved away from the sectors 110.

The weaving may be of the interlock type, as shown. Other three-dimensional or multilayer weaves could be used, such as for example multi-plain or multi-satin weaves. Reference may be made to Document WO 2006/136755.

After weaving, the blank may be shaped in order to obtain a ring sector preform that is consolidated and densified by a ceramic matrix, it being possible in particular for the densification to be performed by chemical vapor infiltration (CVI), which is itself well known.

A detailed example of fabricating CMC ring sectors is described in particular in Document US 2012/0027572.

The ring support structure 103 is made of a metal material such as a Waspaloy® alloy or Inconel 718.

Figure 7:
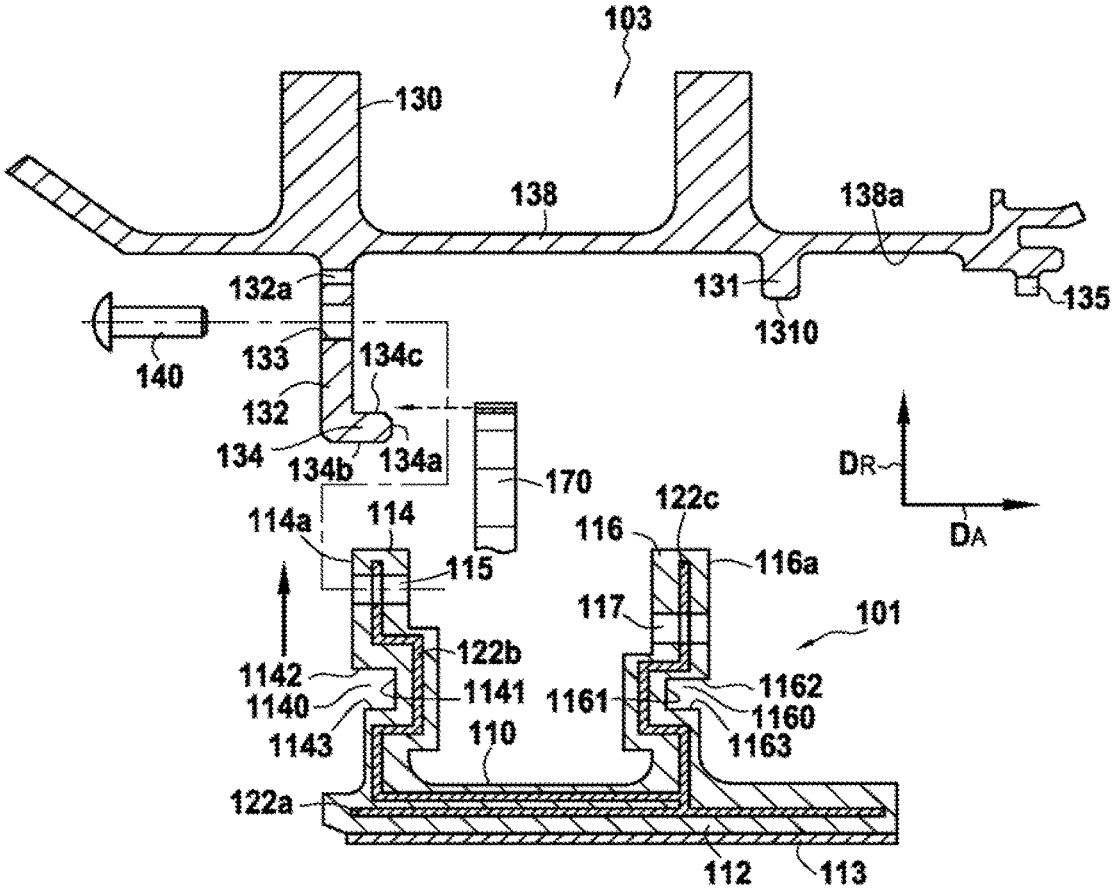
FIGS. 7 to 11 are diagrams showing how a ring sector is mounted in the ring support structure of the FIG. 6 ring assembly.
Figure 8:
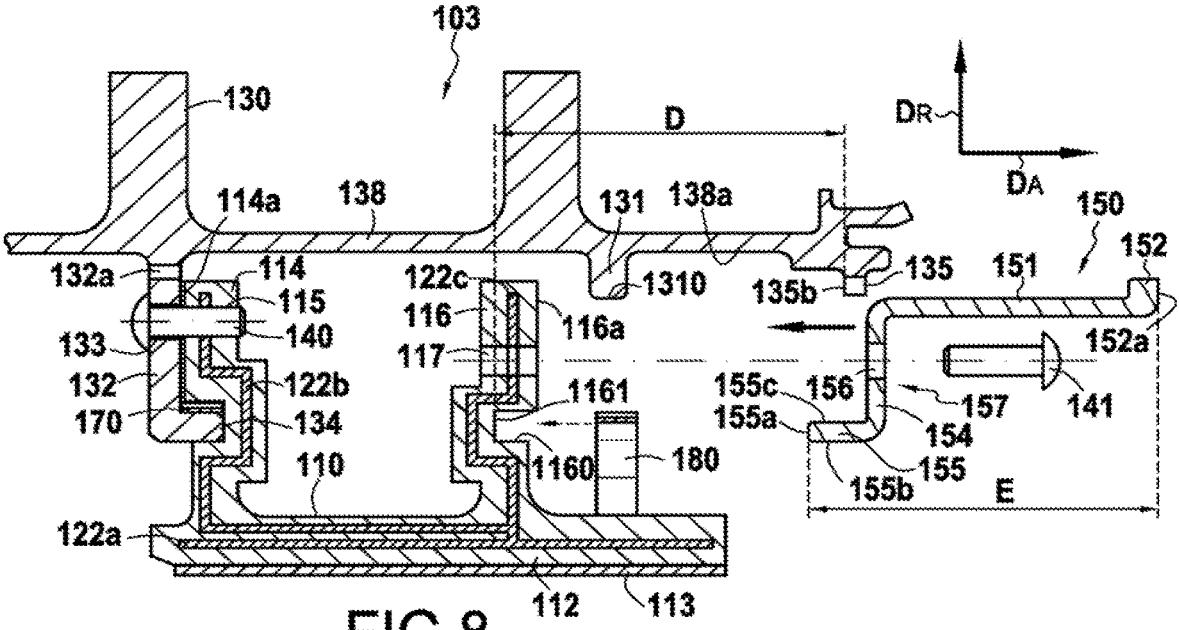

Making of the turbine ring assembly continues by mounting the ring sectors 110 on the ring support structure 103. As shown in FIGS. 7 and 8, the ring sectors 110 are initially fastened via their upstream tabs 114 to the upstream annular radial flange 132 of the ring support structure 103 by means of pegs 140 that are engaged in the aligned orifices 133 and 115 formed respectively in the upstream annular radial flange 132 and in the upstream tabs 114, the annular corrugated sheet 170 previously being placed against the top face 134*c* of the projection 134 of the upstream annular radial flange 132. The projection 134 present on the flange 132 is engaged in the grooves 1140 present in the tabs 114.

Once all of the ring sectors 110 have been fastened in this way on the upstream annular radial flange 132, the annular retention band 150 is assembled by twist-lock jaw coupling between the turbine casing 103 and the downstream tabs 116 of the ring sectors 110. In the presently-described embodiment, the spacing E between the upstream annular radial flange 154 formed by the annular web 157 of the band 150 and the outer surfaces 152*a* of the teeth 152 of said band is greater than the distance D present between the end walls 1161 of the grooves 1160 in the downstream tabs 116 of the ring sectors and the inner faces 135*b* of the teeth 135 present on the turbine casing 130 (FIG. 8).

By defining spacing E between the upstream annular radial flange and the outer surfaces of the teeth of the band that is greater than the distance D between the end walls of the grooves in the downstream tabs of the ring sectors and the inner faces of the teeth present on the turbine casing, it is possible to mount the ring sectors with prestress between the flanges of the ring support structure. Nevertheless, in order to avoid damaging the CMC tabs of the ring sectors during mounting, and in accordance with the invention, the ring support structure includes at least one annular flange that is elastically deformable in the axial direction $D_A$ of the ring. In the presently-described example, it is the downstream annular radial flange 154 present on the band 150 that is elastically deformable. Specifically, the annular web 157 forming the downstream annular radial flange 154 of the ring support structure 103 presents thickness that is small relative to the thickness of the upstream annular radial flange 132, thereby imparting a degree of resilience thereto.

Figure 10:
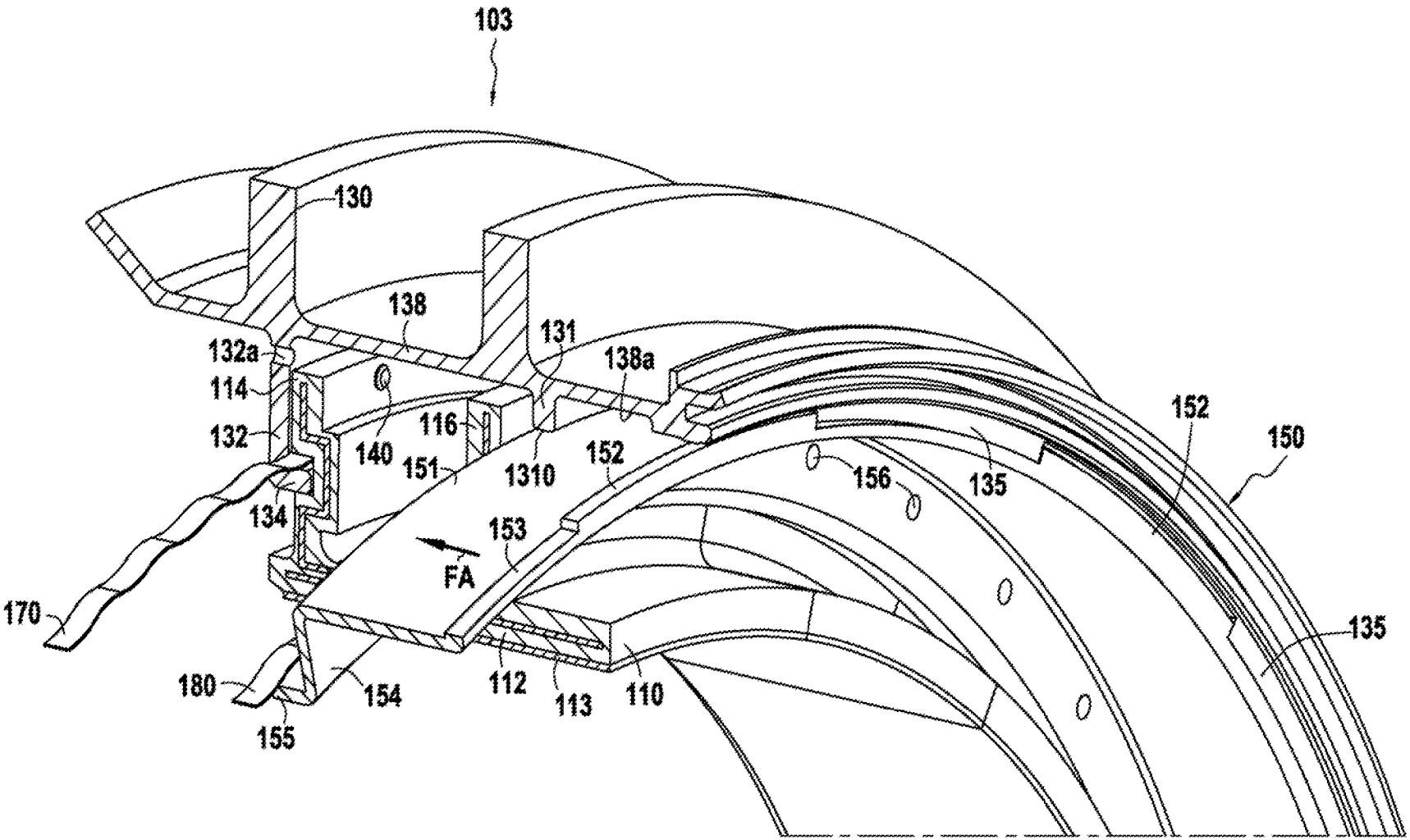
Figure 11:
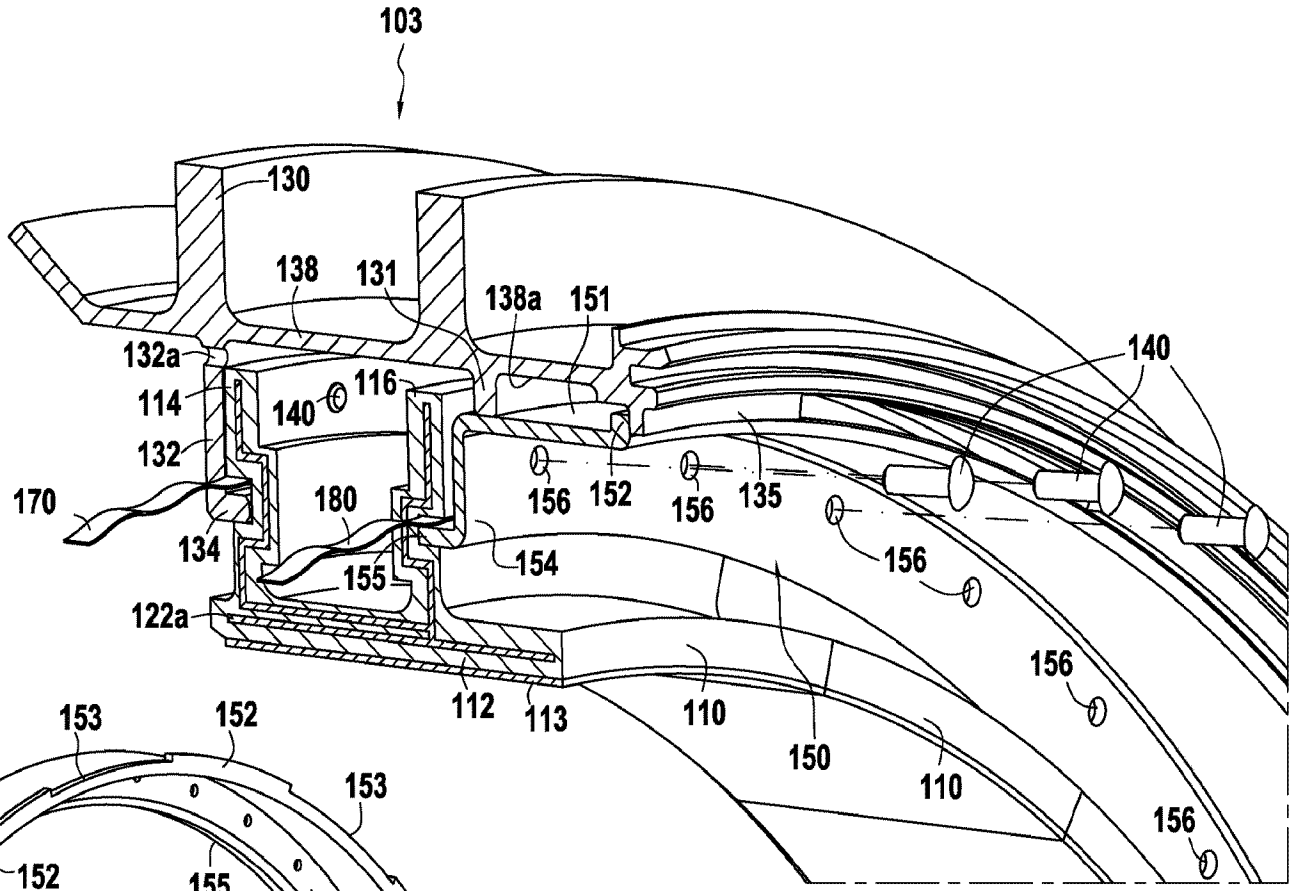

As shown in FIGS. 9, 10, and 11, the band 150 is mounted on the turbine casing 130 by placing the annular corrugated sheet 180 against the top face 155*c* of the projection 155 of the upstream annular radial flange 154 of the band 150 and by engaging the projections 155 in the grooves 1160 present in the downstream tabs 116. In order to fasten the band 150 by twist-lock jaw coupling, the teeth 152 present on the band 150 are initially positioned facing engagement passages 136 formed in the turbine casing 130, with the teeth 135 present on said turbine casing likewise being placed facing engagement passages 153 formed between the teeth 152 on the band 150. Since the spacing E is greater than the distance D, it is necessary to apply an axial force $F_A$ on the band 150 in the direction shown in FIG. 10 in order to engage the teeth 152 beyond the teeth 135 so as to allow the band to be turned R through an angle corresponding substantially to the width of the teeth 135 and 152. After turning in this way, the band 150 is released, with it then being held under axial stress between the upstream tabs 116 of the ring sectors 110 and the inner surfaces 135*b* of the teeth 135 of the turbine casing 130.

Once the band has been put into place in this way, pegs 141 are engaged in the aligned orifices 156 and 117 formed respectively in the downstream annular radial flange 154 and in the downstream tab 116. Each tab 114 or 116 of the ring sector may include one or more orifices for passing a blocking peg.

In a variant embodiment, the corrugated sheets 170 and 180 may be placed between the bottom walls of the grooves in the tabs of the ring sectors and the bottom faces of the projections of the annular radial flanges. Under such circumstances, the corrugated sheets 170 and 180 provide resilient holding of the ring sectors 110 in the radial direction $D_R$ via alternating points of contact firstly between the bottom walls 1143 of the grooves 1140 of the upstream tabs 114 and the bottom face 134*b* of the projection 134 of the upstream annular radial flange 132 (for the sheet 170), and secondly between the bottom walls 1163 of the grooves 1160 of the upstream tabs 116 and the bottom face 155*b* of the projection 155 of the downstream annular radial flange 154 (for the sheet 180).

The invention claimed is:

1. A turbine ring assembly comprising:

a plurality of ring sectors made of ceramic matrix composite material forming a turbine ring; and a ring support structure having first and second annular flanges, each ring sector having a portion forming an annular base with an inner face defining an inside face of the turbine ring and an outer face from which first and second tabs extend radially, the tabs of each ring sector being held between the two first and second annular flanges of the ring support structure, the first and second tabs of the ring sectors each having an annular groove in a face respectively facing the first annular flange and the second annular flange of the ring support structure, the first and second annular flanges of the ring support structure each having an annular projection on a face facing one of the ring sector tabs, the annular projection of the first annular flange being received in the annular groove of the first tab of each ring sector, and the annular projection of the second annular flange is received in the annular groove of the second tab of each ring sector, at least one resilient element being interposed between the annular projection of the first flange and the annular grooves of the first tabs, and al-se between the annular projection of the second flange and the annular grooves of the second tabs, wherein each resilient element is interposed in a radial direction between top walls of the annular grooves present in the first tabs, or respectively the second tabs, of the ring sectors and a top wall of the annular projection of the first flange, or respectively of the second flange, of the ring structure; or between bottom walls of the annular grooves present in the first tabs, or respectively the second tabs of the ring sectors and a bottom wall of the annular projection of the first flange, or respectively of the second flange, of the ring structure, and wherein each resilient element exerts a holding force on the ring sectors that is directed in the radial direction.

2. The turbine ring assembly according to claim 1, wherein each resilient element is formed by a split annular collar mounted with elastic prestress between one of the annular projections and the corresponding grooves.

3. The turbine ring assembly according to claim 1, wherein each resilient element is formed by at least one strip of a rigid material presenting a corrugated shape.

4. The turbine ring assembly according to claim 1, wherein the projections of the two annular flanges of the ring support structure exert stress on the annular grooves of the tabs of the ring sectors, and wherein one of the flanges of the ring support structure is elastically deformable in an axial direction of the turbine ring.

5. The turbine ring assembly according to claim 4, wherein the elastically deformable flange of the ring support structure presents a thickness that is less than a thickness of the other flange of the ring support structure.

6. The turbine ring assembly according to claim 4, wherein the elastically deformable flange of the ring support structure has a plurality of hooks distributed over a face opposite from the face facing the tabs of the ring sectors.

7. The turbine ring assembly according to claim 1, wherein the ring support structure includes an annular retention band mounted on the turbine casing, the annular retention band including an annular web forming one of the flanges of the ring support structure, and wherein the band has a first series of teeth distributed in circumferential manner on said band while the turbine casing has a second series of teeth distributed in circumferential manner on said casing, the teeth of the first series of teeth and the teeth of the second series of teeth together forming a circumferential twist-lock jaw coupling.

8. The turbine ring assembly according to claim 7, wherein the turbine casing includes an annular projection extending between a shroud of said casing and the band of the ring structure.

9. The turbine ring according to claim 1, wherein the first tab is disposed upstream of the second tab, the annular groove of the first tab is provided in an upstream face of the first tab and the annular groove of the second tab is provided in a downstream face of the second tab, and the annular projection of the first annular flange extends downstream from a downstream face of the first annular flange and the annular projection of the second annular flange extends upstream from an upstream face of the second annular flange.

10. The turbine ring according to claim 9, wherein a distance between a free end of the annular projection of the first annular flange and a free end of the annular projection of the second annular flange is less than a distance between an end wall of the annular groove of the first tab and an end wall of the annular groove of the second tab.

* * * * *